US007753062B2

(12) United States Patent
Burrows et al.

(10) Patent No.: US 7,753,062 B2
(45) Date of Patent: Jul. 13, 2010

(54) SPRAY ARM FOR A DISHWASHER, AND ASSOCIATED METHOD

(75) Inventors: James L. Burrows, Winterville, NC (US); Gregory A. Meyer, Batesville, IN (US)

(73) Assignee: Electrolux Home Products, Inc., Cleveland, OH (US)

( * ) Notice: Subject to any disclaimer, the term of this patent is extended or adjusted under 35 U.S.C. 154(b) by 372 days.

(21) Appl. No.: 12/043,594

(22) Filed: Mar. 6, 2008

(65) Prior Publication Data

US 2008/0271759 A1 Nov. 6, 2008

Related U.S. Application Data

(60) Provisional application No. 60/916,181, filed on May 4, 2007.

(51) Int. Cl.
*B08B 3/02* (2006.01)

(52) U.S. Cl. ..... 134/198; 29/890.142

(58) Field of Classification Search ..... 134/198; 29/890.142

See application file for complete search history.

(56) References Cited

U.S. PATENT DOCUMENTS 2,905,393 A 9/1959 Federighi et al.
3,809,106 A 5/1974 Crabtree
4,172,463 A 10/1979 Woolley et al.
4,387,496 A 6/1983 Spiegel
4,418,868 A 12/1983 Gurubatham et al.
4,991,611 A 2/1991 Jarvis et al.
5,267,582 A 12/1993 Purtilo
5,662,744 A 9/1997 Tuller et al.
6,662,814 B2 12/2003 Tobbe et al.
6,964,090 B2 11/2005 Mathieu et al.

FOREIGN PATENT DOCUMENTS

FR 2 262 900 9/1975

*Primary Examiner*—Michael Cleveland
*Assistant Examiner*—Samuel A Waldbaum
(74) *Attorney, Agent, or Firm*—Alston & Bird LLP

(57) ABSTRACT

A spray arm for a dishwasher is provided, comprising a first portion having a first engaging surface extending about an outer surface periphery thereof, and a second portion having a second engaging surface extending about the outer surface thereof and complementarily configured with respect to the first engaging surface. The engaging surfaces form a laterally-extending, non-linear interface upon engagement such that the first and second portion outer surfaces are directed away from each other. The second portion also includes a flange extending about the outer surface, and disposed laterally outward of and spaced apart from the second engaging surface, to define a channel having a depth extending across the interface. A securing material is introduced into and substantially fills the channel, and extends across the interface and about the first portion outer surface periphery, to secure the first and second portions together. An associated method is also provided.

15 Claims, 2 Drawing Sheets

100

Figures 1A, 1B, 1C, 1D, 1E, 1F, 1G:
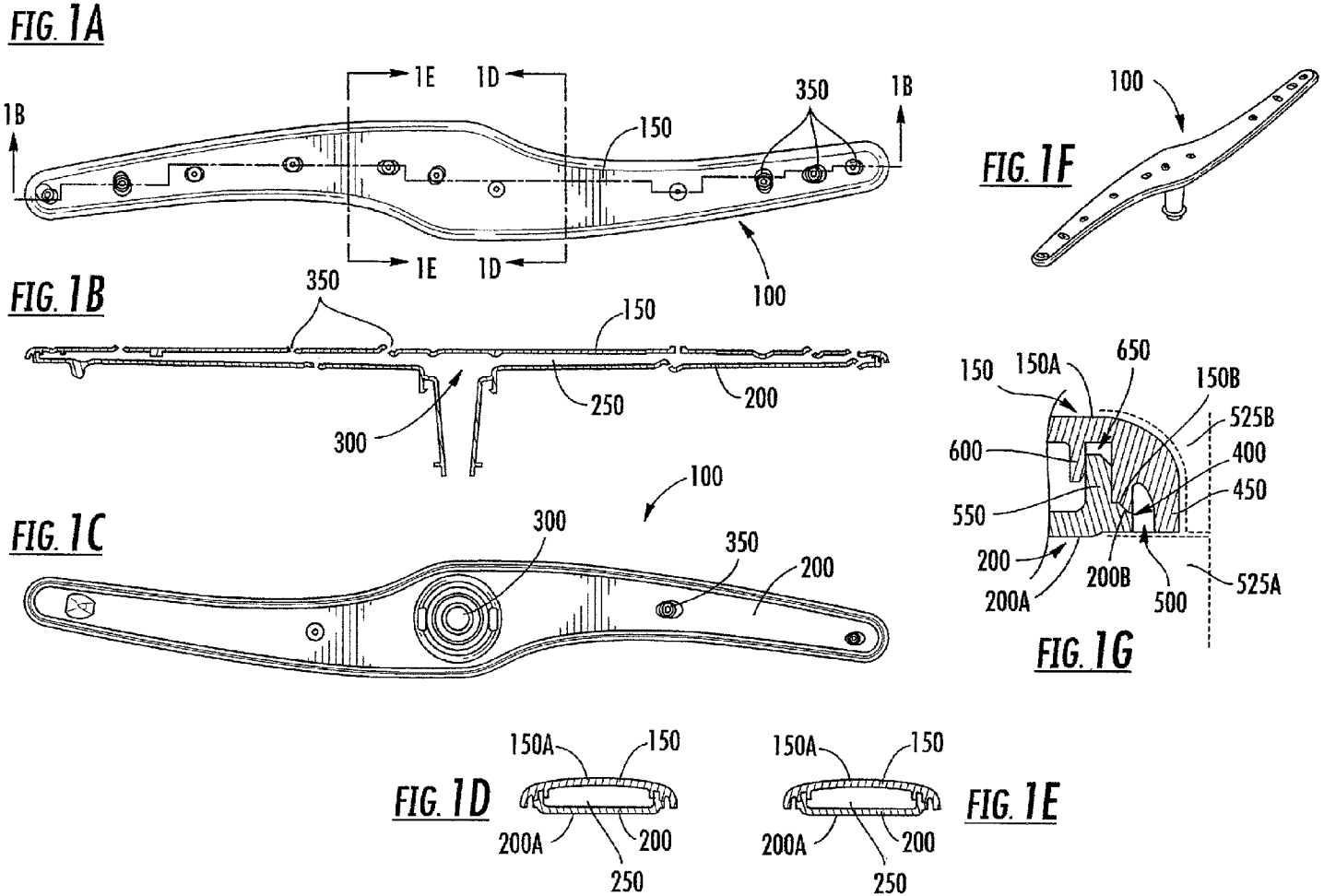
Figure 2E:
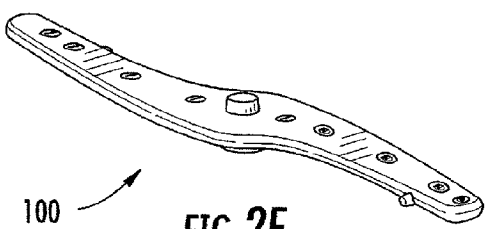
Figure 2F:
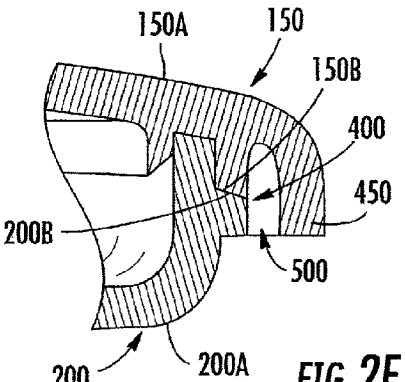
Figure 2A:
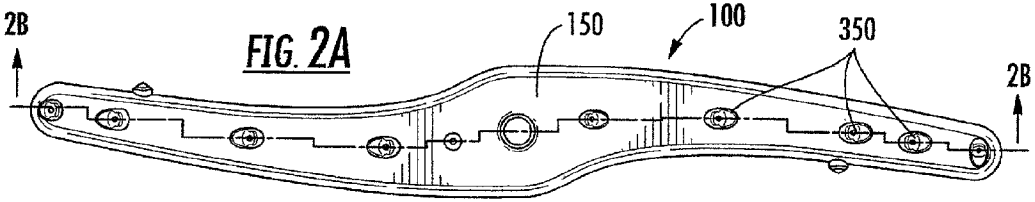
Figure 2B:
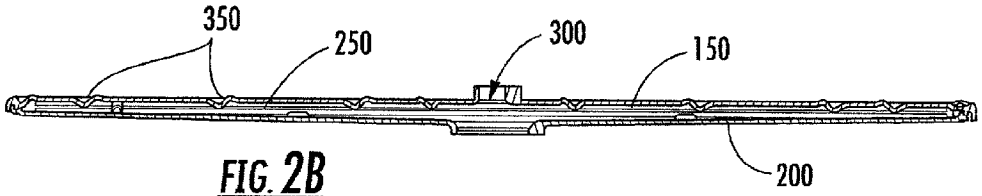
Figure 2C:
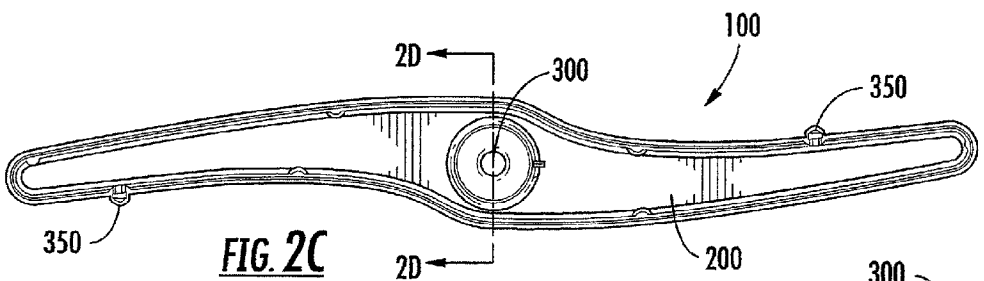
Figure 2D:
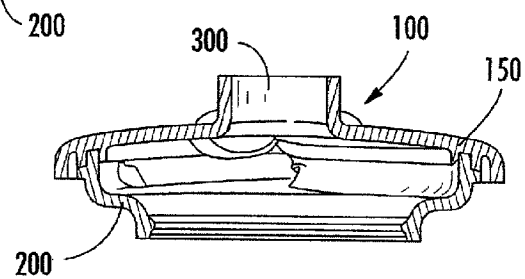

150B
525B
400
450
525A
500
650
200B
150A
150
600
550
200
200A 1B
350
100
150
1D
1E
200
250
300

SPRAY ARM FOR A DISHWASHER, AND ASSOCIATED METHOD

CROSS-REFERENCE TO RELATED APPLICATIONS

This application claims the benefit of U.S. Provisional Application No. 60/916,181, filed May 4, 2007, the contents of which are incorporated herein by reference.

BACKGROUND OF THE INVENTION

1. Field of the Invention

Embodiments of the present invention relate to dishwashers and, more particularly, to a spray arm for a dishwasher, and a forming method associated therewith.

2. Description of Related Art

A dishwasher typically includes a front-opening wash tub for receiving dishware to be washed. Associated with the tub is a sump defined by or otherwise disposed about the lower end of the tub, wherein the sump is configured to collect, under the influence of gravity, the dishwashing fluid circulated in the tub. Typically, the dishwashing fluid, such as water, is circulated by a circulation pump and sprayed or otherwise dispensed through one or more spray arms operably arranged within and/or with respect to the tub. The fluid dispensed through the spray arm(s) is directed onto the dishware within the tub for removing food soils and other debris therefrom. After interacting with the dishware, the used dishwashing fluid typically drains under the influence of gravity toward the sump, wherein food soils and debris from the dishware are typically strained and/or filtered from the dishwashing fluid prior to recirculation thereof.

Some spray arms are configured to define an internal space or channel for receiving the dishwashing fluid therein, typically though a central port about which the spray arm rotates. Once the dishwashing fluid is received in the internal space of the spray arm, the fluid is dispensed from the spray arm through one or more nozzles onto the dishware within the tub. Such spray arms may be formed of a molded material, such as a plastic or other suitable polymer. Due to limitations associated with the molds used in the molding process, such spray arms defining an interior space must often be assembled from two or more separately-molded portions.

In forming the spray arm assembly from the two or more portions, various processes may be used. For example, the portions may be secured together by adhesives, or by a sonic welding or vibration welding process. However, adhesives may be costly or otherwise difficult to implement in mass production. Further, welding processes may experience, for example, difficulty in maintaining a consistent weld along the joint seam between the portions of the spray arm. In addition, such sonic welding or vibration welding processes may tend to displace material forming the spray arm portions from the joint seam therebetween, which may reduce the wall thickness of the spray arm at or about the joint seam. If such issues are encountered, extensive re-work may be required or the defective assembly may have to be discarded.

In other instances, the separately-molded portions may be joined together using an overmolding process, whereby a band of overmolding material is wrapped about the outer surfaces of the engaged portions, generally perpendicular to the longitudinal direction thereof. Such "banded" overmolding, however, may not form or facilitate a watertight seal between the joined spray arm portions. Further, the banding may be aesthetically undesirable or may undesirably form sites for collection of food soils and debris.

Accordingly, an improved multi-portion spray arm for a dishwasher and associated method may be desirable.

BRIEF SUMMARY OF THE INVENTION

The above and other needs are met by the present invention which, in one aspect, provides a spray arm for a dishwasher. Such a spray arm comprises a first spray arm portion having a laterally-extending outer surface and a first engaging surface substantially opposed thereto, wherein the first engaging surface extends substantially about a periphery of the outer surface of the first spray arm portion. A second spray arm portion has a laterally-extending outer surface and a second engaging surface substantially opposed thereto, wherein the second engaging surface extends substantially about the outer surface of the second spray arm portion, and is complementarily configured with respect to the first engaging surface, so as to form a laterally-extending, non-linear interface on engagement therewith such that the outer surfaces of the first and second spray arm portions are directed away from each other. The second spray arm portion further includes a flange extending about the outer surface thereof. The flange is disposed laterally outward of the second engaging surface, and is spaced apart therefrom, so as to define a channel having a depth extending across the interface. A securing material is configured to be received by the channel and to substantially fill the channel to the depth thereof, so as to extend across the interface of the first and second engaging surfaces and substantially about the periphery of the outer surface of the first spray arm portion, to secure the first and second spray arm portions together, and such that the first and second spray arm portions cooperate to define an interior space therebetween, laterally inward of the interface, for receiving a dishwashing fluid therein for dispensation therefrom.

Another aspect of the present invention comprises a method of forming a spray arm for a dishwasher. Such a method comprises engaging a first spray arm portion with a second spray arm portion. The first spray arm portion has a laterally-extending outer surface and a first engaging surface substantially opposed thereto, with the first engaging surface extending substantially about a periphery of the outer surface of the first spray arm portion. The second spray arm portion has a laterally-extending outer surface and a second engaging surface substantially opposed thereto, with the second engaging surface extending substantially about the outer surface of the second spray arm portion and being complementarily configured with respect to the first engaging surface. The engaged spray arm portion thereby form a laterally-extending, non-linear interface between the first and second engaging surfaces, such that the outer surfaces of the first and second spray arm portions are directed away from each other. The second spray arm portion further includes a flange extending about the outer surface thereof, The flange is disposed laterally outward of the second engaging surface and is spaced apart therefrom so as to define a channel having a depth extending across the interface. A securing material is then introduced into the channel so as to substantially fill the channel to the depth thereof, and such that the securing material extends across the interface of the first and second engaging surfaces and substantially about the periphery of the outer surface of the first spray arm portion to secure the first and second spray arm portions together. The secured first and second spray arm portions thus cooperate to define an interior space therebetween, laterally inward of the interface, for receiving a dishwashing fluid therein for dispensation therefrom.

Aspects of the present invention thus provide significant advantages as further detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIGS. 1A-1G are various schematic views of a spray arm for a dishwasher, according to one embodiment of the present invention, implemented as a lower spray arm in a dishwasher; and FIGS. 2A-2F are various schematic views of a spray arm for a dishwasher, according to an alternate embodiment of the present invention, implemented as a middle spray arm in a dishwasher.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIGS. 1A-1G and 2A-2F schematically illustrate a spray arm for a dishwasher according to one embodiment of the present invention, the spray arm being generally indicated by the numeral 100. Such a spray arm 100 is shown as being formed from two separate and discrete spray arm portions 150, 200, though such a spray arm 100 may be formed from more than two portions when necessary or desirable. In some instances, the portions 150, 200 may be formed using, for example, an injection molding process using, for instance, a thermoplastic material or polymer In addition, such a spray arm 100 may be implemented on any level within a dishwasher, namely as a lower spray arm (under the lower dish rack), as a middle spray arm (between the upper and lower dish racks), or as an upper spray arm (above the upper dish rack), though only lower (FIGS. 1A-1G) and middle (FIGS. 2A-2F) spray arms are illustrated as examples herein.

The spray arm portions 150, 200 each include an outer surface 150A, 200A, and are configured to cooperate to define an interior space 250 therebetween, when the spray arm portions 150, 200 are engaged such that the outer surfaces 150A, 200A are directed or otherwise generally face away from each other. The spray arm 100 is configured to receive a dishwashing liquid (not shown) through a central port or hub 300 thereof and into the interior space 250, wherein the spray arm 100 may be configured to be supported via the central port 300 and rotatable thereabout. The dishwashing fluid received within the interior space 250 is dispensed through one or more spray apertures or nozzles 350 onto the dishware within the dishwasher, wherein the nozzles 350 may also be configured such that the dispensation of the dishwashing fluid therethrough causes the spray arm 100 to rotate about the central port 300. The nozzles 350 may be defined by or engaged with either of the spray arm portions 150, 200, or may be defined through cooperation between the spray arm portions 150, 200 about an interface 400 therebetween (see, e.g., FIG. 2A).

In order to reliably and efficiently dispense the dishwashing fluid from the spray arm 100 via the nozzles 350, the engagement between the spray arm portions 150, 200 must be sufficiently fluid-tight. As such, one aspect of the present invention is directed to a method of engaging the spray arm portions 150, 200 and the configurations of the spray arm portions providing the resulting spray arm 100. In one embodiment, a first spray arm portion 200 is configured to include a first engaging surface 200B substantially opposing the laterally-extending outer surface 200A thereof. The first engaging surface 200B may be further configured to extend substantially about a periphery of the outer surface 200A of the first spray arm portion 200.

A second spray arm portion 150 also includes a second engaging surface 150B substantially opposing the laterally-extending outer surface 150A thereof. The second engaging surface 150B may be further configured to extend substantially about the outer surface 150A of the second spray arm portion 150. That is, the second engaging surface 150B may be disposed laterally inward of the periphery of the outer surface 150A of the second spray arm portion 150. In any instance, the second engaging surface 150B may be complementarily configured with respect to the first engaging surface 200B of the first spray arm portion 200. In such instances, when the respective engaging surfaces 150B, 200B of the spray arm portions 150, 200 are engaged (i.e., to assemble the spray arm 100), the engaging surfaces 150B, 200B form a laterally-extending, non-linear interface 400, and the outer surfaces 200A, 150A are directed away from each other. The non-linear interface 400 may be oriented in many different manners and may serve different purposes. For example, the inclined interface 400 (see, e.g., FIGS. 1G and 2F) may increase the engagement area between the engaging surfaces 150B, 200B, and/or serve to center or otherwise align the spray arm portions 150, 200 with respect to each other. As shown, the resulting interface 400 is evidenced by a seam about the spray arm, along a wall extending generally perpendicularly to the planes of the outer surfaces 150A, 200A.

In one embodiment, the second spray arm portion 150 further includes a flange 450 extending about the periphery of the outer surface 150A thereof. That is, the flange 450 may comprise an integral portion of (or be otherwise operably engaged with) the second spray arm portion 150 that extends from the outer surface 150A and laterally outward of the second engaging surface 150B. As shown, in one embodiment, the flange 450 extends outwardly of the second engaging surface 150B so as to be spaced apart from the wall defining the seam between the spray arm portions 150, 200. As such, the flange 450 and the wall defining the seam cooperate to further define a channel 500 having a depth extending across the interface 400 between the spray arm portions 150, 200. The channel 500 thus extends substantially about the periphery of the spray arm 100, in correspondence with the engaging surfaces 150B, 200B. In some instances, either or both of the engaging surfaces 150B, 200B, as well as the channel 500, may be interrupted, for example, by a nozzle 350 extending at least partially through the wall defining the seam (see, e.g., FIGS. 2A and 2C). In such instances, either or both of the engaging surfaces 150B, 200B may be discontinuous across the nozzle 350, and the channel 500 may include an end wall (not shown) adjacent to or formed by the nozzle 350.

In assembling the spray arm 100, the spray arm portions 150, 200 are physically engaged such that the engaging surfaces 150B, 200B are joined together. The spray arm portions 150, 200 are held in engagement by two or more mold elements (shown in phantom in FIG. 1G as elements 525A and 525B) engaging the outer surfaces 150A, 200A of the respective spray arm portions 150, 200. In some instances, the mold elements 525A, 525B may be configured to correspond to the contours of the outer surfaces 150A, 200A of the respective spray arm portions 150, 200. At least one of the mold elements 525A extends across the channel 500, from the flange 450 to the wall defining the seam (i.e., the outer surface 150A of the first spray arm portion 150) and encloses the channel 500 about the spray arm 100. The at least one mold element 525A further defines one or more injection ports (not shown) extending into the channel 500. As such, the spray arm portions 150, 200 held together by the mold elements 525A, 525B may be subjected to a further molding process, whereby a molding substance (not shown) or other suitable securing material may be injected into the channel 500, via the injection port(s) defined by one mold element 525A. The molding substance or securing material may be, for example, a suitable polymeric material such as the polymeric material comprising the spray arm portions 150, 200 or other substantially similar polymeric material. Because such an injection molding process must be performed at an elevated temperature to allow the molding substance to flow into and about the channel 500 (or the channel portions, if the channel 500 is discontinuous), and to conform thereto, the portions of the spray arm 100 defining the channel 500 may also be exposed to an elevated temperature. As such, the engaging surfaces 150B, 200B and the flange 450 may be partially melted during the molding process so as to allow the molding substance or securing material to become welded or fused therewith.

Upon cooling or solidification of the molding substance, the spray arm 100 is removed from the mold elements 525A, 525B and, due to the configuration of the mold elements 525A, 525B, the filled channel 500 is substantially flush with the channel opening. Further, because the molding substance fills the channel 500 to the depth thereof, the solidified molding substance extends across the seam between the engaging surfaces 150B, 200B, in a fused relationship therewith, and thus seals the spray arm portions 150, 200 together in a fluid-tight manner. As such, any dishwashing fluid entering the interior space 250 is efficiently dispensed from the nozzle(s) 350.

In some instances, since the molding substance is injected into the channel 500 during the molding process, some of the molding substance may enter the interface 400 between the engaging surfaces 150B, 200B and undesirably enter the interior space 250 of the spray arm 100. In order to prevent or minimize such an occurrence, the spray arm portions 150, 200 may further include one or more supplemental flanges 550, 600 configured to interact with each other and/or the inner surface of the wall defining the seam (see, e.g., FIG. 1G) to form a labyrinth-like or otherwise non-linear pathway between the wall defining the seam and the interior space 250. For example, one of the first and second spray arm portions 150, 200 (see, e.g., the second spray arm portion 200 shown in FIG. 1G) may further comprise a first supplemental flange 550 disposed laterally inward of and formed contiguously with the corresponding one of the first and second engaging surfaces 150B, 200B (see, e.g., the second engaging surface 200B in FIG. 1G). In such instances, the first supplemental flange 550 may be configured to extend across the interface 400 of the first and second engaging surfaces 150B, 200B, within the interior space 250.

In another embodiment, the other of the first and second spray arm portions 150, 200 (see, e.g., the first spray arm portion 150 shown in FIG. 1G) may further optionally comprise a second supplemental flange 600 disposed laterally inward of and spaced apart from the corresponding one of the first and second engaging surfaces 150B, 200B (see, e.g., the first engaging surface 150B in FIG. 1G) so as to define a flange channel therebetween. The flange channel, in such instances, is configured to receive the first supplemental flange 550. As shown in FIG. 1G, at least one of the first and second supplemental flanges 550, 600 may be chamfered so as to facilitate reception of the first supplemental flange 550 within the flange channel. Accordingly, in such embodiments, the first and optional second supplemental flanges 550, 600 may be configured to cooperate with each other and the interface 400 of the first and second engaging surfaces 150B, 200B, to define a non-linear engagement between the first and second spray arm portions 150, 200, extending from the outer surfaces 150A, 200A to the interior space 250, for substantially preventing the securing material from flowing into the interior space 250 therethrough. Thus, such a pathway may further facilitate alignment of the spray arm portions 150, 200 upon assembly, and may also serve to impede any flow of the molding substance into the interior space 250.

In some instances, the pathway may also include an open volume 650 for collecting any of the molding substance flowing along the pathway, before the molding substance reaches the interior space 250. That is, the flange channel may be further configured to cooperate with the first supplemental flange 550 so as to define an overflow volume 650 along the non-linear engagement 400 between the first and second spray arm portions 150, 200, wherein the overflow volume 650 is adapted to receive any securing material flowing through the interface 400 between the first and second engaging surfaces 150B, 200B so as to substantially prevent the securing material from flowing into the interior space 250 therethrough.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A spray arm for a dishwasher, comprising:

a first spray arm portion having a laterally-extending outer surface and a first engaging surface substantially opposed thereto, the first engaging surface extending substantially about a periphery of the outer surface of the first spray arm portion;

a second spray arm portion having a laterally-extending outer surface and a second engaging surface substantially opposed thereto, the second engaging surface extending substantially about the outer surface of the second spray arm portion and complementarily configured with respect to the first engaging surface so as to form a laterally-extending, non-linear interface on engagement therewith such that the outer surfaces of the first and second spray arm portions are directed away from each other, the second spray arm portion further including a flange extending about the outer surface thereof, the flange being disposed laterally outward of the second engaging surface and spaced apart therefrom so as to define a channel having a depth extending across the interface; and a securing material configured to be received by and to substantially fill the channel to the depth thereof, so as to extend across the interface of the first and second engaging surfaces and substantially about the periphery of the outer surface of the first spray arm portion to secure the first and second spray arm portions together, and such that the first and second spray arm portions cooperate to define an interior space therebetween, laterally inward of the interface, for receiving a dishwashing fluid therein for dispensation therefrom.

2. A spray arm according to claim 1, further comprising at least one nozzle defined by at least one of the first and second spray arm portions, the at least one nozzle being configured to have the dishwashing fluid dispensed therethrough from the interior space.

3. A spray arm according to claim 1, wherein the securing material is configured to be flowable into and about the channel, and to conform thereto, during an injection molding process.

4. A spray arm according to claim 1, wherein the securing material is configured to fuse with the first and second spray arm portions about the interface to form a fluid-tight bond therewith.

5. A spray arm according to claim 1, wherein the first and second spray arm portions and the securing material are comprised of substantially similar polymeric materials.

6. A spray arm according to claim 1, wherein one of the first and second spray arm portions further comprises a first supplemental flange disposed laterally inward of and formed contiguously with the corresponding one of the first and second engaging surfaces, the first supplemental flange being configured to extend across the interface of the first and second engaging surfaces within the interior space.

7. A spray arm according to claim 6, wherein the other of the first and second spray arm portions further comprises a second supplemental flange disposed laterally inward of and spaced apart from the corresponding one of the first and second engaging surfaces so as to define a flange channel therebetween, the flange channel being configured to receive the first supplemental flange, the first and second supplemental flanges being configured to cooperate with each other and the interface of the first and second engaging surfaces, to define a non-linear engagement between the first and second spray arm portions extending from the outer surfaces to the interior space for substantially preventing the securing material from flowing into the interior space therethrough.

8. A spray arm according to claim 7 wherein at least one of the first and second supplemental flanges is chamfered so as to facilitate reception of the first supplemental flange within the flange channel.

9. A spray arm according to claim 7, wherein the flange channel is further configured to cooperate with the first supplemental flange so as to define an overflow volume along the non-linear engagement between the first and second spray arm portions, the overflow volume being adapted to receive any securing material flowing through the interface between the first and second engaging surfaces so as to substantially prevent the securing material from flowing into the interior space therethrough.

10. A method of forming a spray arm for a dishwasher, comprising:

engaging a first spray arm portion with a second spray arm portion, the first spray arm portion having a laterally-extending outer surface and a first engaging surface substantially opposed thereto, with the first engaging surface extending substantially about a periphery of the outer surface of the first spray arm portion, and the second spray arm portion having a laterally-extending outer surface and a second engaging surface substantially opposed thereto, with the second engaging surface extending substantially about the outer surface of the second spray arm portion and complementarily configured with respect to the first engaging surface, so as to form a laterally-extending, non-linear interface between the first and second engaging surfaces and such that the outer surfaces of the first and second spray arm portions are directed away from each other, the second spray arm portion further including a flange extending about the outer surface thereof, the flange being disposed laterally outward of the second engaging surface and spaced apart therefrom so as to define a channel having a depth extending across the interface; and introducing a securing material into the channel so as to substantially fill the channel to the depth thereof, and such that the securing material extends across the interface of the first and second engaging surfaces and substantially about the periphery of the outer surface of the first spray arm portion, to secure the first and second spray arm portions together, and such that the first and second spray arm portions cooperate to define an interior space therebetween, laterally inward of the interface, for receiving a dishwashing fluid therein for dispensation therefrom.

11. A method according to claim 10, further comprising maintaining the first and second spray arm portions in engagement between at least two opposing mold elements configured to operably engage the outer surfaces of the first and second spray arm portions, at least one of the mold elements being configured to extend across the channel from the flange to the outer surface of the first spray arm portion so as to enclose the channel, the at least one of the mold elements defining at least one injection port extending into the channel.

12. A method according to claim 11, wherein introducing a securing material into the channel further comprises introducing the securing material into the channel through the at least one injection port defined by the at least one of the mold elements.

13. A method according to claim 10, wherein introducing a securing material into the channel further comprises introducing a flowable securing material into the channel during an injection molding process such that securing material conforms to the channel and fuses with the first and second spray arm portions about the interface to form a fluid-tight bond therewith.

14. A method according to claim 10, wherein the first and second spray arm portions are comprised of a polymeric material, and introducing a securing material into the channel further comprises introducing a polymeric securing material, substantially similar to the polymeric material of the first and second spray arm portions, into the channel to secure the first and second spray arm portions together.

15. A method according to claim 10, wherein one of the first and second spray arm portions further comprises a first supplemental flange disposed laterally inward of and formed contiguously with the corresponding one of the first and second engaging surfaces, the first supplemental flange being configured to extend across the interface of the first and second engaging surfaces within the interior space, and the other of the first and second spray arm portions further comprises a second supplemental flange disposed laterally inward of and spaced apart from the corresponding one of the first and second engaging surfaces so as to define a flange channel therebetween, the flange channel being configured to receive the first supplemental flange, and engaging the first and second spray arm portions further comprises engaging the first and second spray arm portions such that the first and second supplemental flanges cooperate with each other and the interface of the first and second engaging surfaces to define a non-linear engagement between the first and second spray arm portions extending from the outer surfaces to the interior space for substantially preventing the securing material from flowing into the interior space therethrough.

* * * * *